US005277350A

United States Patent [19]

Thornbury, Jr.

[11] Patent Number: 5,277,350

[45] Date of Patent: Jan. 11, 1994

[54] KITE REEL ASSEMBLY

[76] Inventor: Fred B. Thornbury, Jr., 3372 Los Prados, San Mateo, Calif. 94403

[21] Appl. No.: 47,922

[22] Filed: Apr. 19, 1993

[51] Int. Cl.[5] ..... B65H 75/40

[52] U.S. Cl. ..... 244/155 A; 242/96

[58] Field of Search ..... 244/153 R, 155 R, 155 A; 242/96, 250, 242/54 R

[56] References Cited

U.S. PATENT DOCUMENTS

| | | | |
|---|---|---|---|
| 3,630,464 | 12/1971 | Fagan | 242/96 |
| 3,910,524 | 10/1975 | Ireland | 242/250 |
| 4,129,273 | 12/1978 | Hill | 242/96 |
| 4,196,864 | 4/1980 | Cole | 242/54 R |
| 4,416,429 | 11/1983 | Jessamine | 242/96 |
| 4,915,320 | 4/1990 | Neal | 242/96 |
| 4,962,901 | 10/1990 | Shirley et al. | 242/250 |
| 5,071,085 | 12/1991 | Beers | 244/155 A |
| 5,190,237 | 3/1993 | Fagan | 242/96 |

*Primary Examiner*—Galen L. Barefoot
*Attorney, Agent, or Firm*—T. R. Zegree

[57] ABSTRACT

A kite reel assembly suitable for manual kite string unwinding operation and for kite retrieval operation at a very high speed includes a spool coupled with a power-driven drill-like means comprising a novel adapter insertable therein for connection with the spool. The assembly comprises interchangeable elements which are easily replaceable for coupling with the spool.

10 Claims, 1 Drawing Sheet

KITE REEL ASSEMBLY

BACKGROUND OF THE INVENTION

This invention relates to an improved kite reel assembly. More particularly, the invention relates to a power-driven reel assembly for use in flying a kite attached thereto by a string or cord which may be unwound manually and rewound at a high speed by power means.

As is well known, kites have been flown for a long time primarily as a hobby or a recreational pastime by children, teenagers and adults. Most kites now in use are typically operated manually in unwinding the string of the kite from the reel to let it fly at a high altitude and winding it up on the reel to its original position after the flying has been completed. As the kite retrieving operation by hand is time-consuming, attempts have been made in the prior art to speed it up by providing power-driven reels. However, such reels have not been proven entirely satisfactory due to their complicated mechanisms, short duration of power source and a low speed of rotation. In consequence, they have not been commercially successful. For example, the patent literature describing power-driven kite reels includes U.S. Pat. No. 3,593,940 describing a power-driven reel having a pair of opposite handles, one of which houses a battery, while the other houses a driving motor. U.S. Pat. No. 3,822,839 shows a kite string reel having a motor and a speed reduction gear, both mounted in a single handle. U.S. Pat. No. 4,915,320 discloses a kite reel operable either manually or power-driven using a conventional cordless screwdriver rotating at a low speed; and U.S. Pat. No. 5,190,237 describes a kite reel powered by a conventional electric screwdriver mounted on one side of the reel and a handle mounted on the opposite side thereof.

While the above-listed patents disclose a general concept of powered kite reel mechanisms having different structures, the reel assembly of the present invention provides a new approach to the structure and operation thereof which offers certain advantages over the prior art devices.

OBJECTS OF THE INVENTION

In view of the foregoing, it is a principal object of this invention to provide a kite reel assembly which can operate retrieval of a kite after its flying at a high altitude in a very short period of time.

Another object of the invention involves a novel kite reel assembly which can be operated either manually for unwinding the kite string or by a powered drill-like means having a high rotational speed.

Still another object of the invention is to provide a reel kite assembly of the character described which permits a highly efficient and easy rewinding operation of the kite string and which can be manufactured at a relatively low cost from readily available materials.

BRIEF SUMMARY OF THE INVENTION

These and other objects of the present invention will become more fully apparent from the following description considered in conjunction with the accompanying drawings.

In accordance with the invention, there is provided a kite reel assembly for use in flying a kite attached by a string thereto. The assembly comprises, in combination, a hollow string-winding spool having a pair of circular disks spaced from each other and positioned at each end of the spool; a rotatable first handle which houses the outer portion of a first drive shaft extending through the central opening in the first disk, the inner portion of the first drive shaft extending inwardly of the first disk and having a square-shaped aperture at its inner end; a bushing attached to the inner face of the first disk in alignment with the central opening of said first disk; a removable, rotatable second handle housing an outer portion of a second drive shaft extending inwardly through the center opening in the second disk, the inner portion of the second drive shaft having mounted thereon a pair of axially spaced apart outer and inner bushings, the outer bushing being adapted to be positioned flush with the outer face of the second disk and being adjacent the inner end of said second handle. The inner bushing is located adjacent the free end of the second drive shaft and has a square-shaped tip adapted for a snug insertion into the square-shaped aperture in the inner end of the first drive shaft; a high-speed power drill-like means comprising an adapter coupled with the chuck of the drill-like means and having the third drive shaft with a bushing mounted thereon adjacent the chuck when inserted therein, the free end of the third drive shaft having likewise a square-shaped tip adapted for slidably snug insertion into the square-shaped aperture in the inner free end of the first drive shaft. The third drive shaft is axially aligned with the first drive shaft for rotation therewith. The drill-like means is adapted for interchangeable coupling with the first drive shaft upon removal of the second handle from the reel assembly.

An auxiliary removable crank handle member, described hereinafter, is useful for interchangeable insertion of its drive shaft into the aperture of the first drive shaft for manual rewinding of the string as a replacement of the drill-like means when the power thereof has been used up after flying a kite for a long time.

BRIEF DESCRIPTION OF THE DRAWINGS

In the accompanying drawings, wherein like reference characters designate corresponding elements throughout the views thereof.

DETAILED DESCRIPTION OF THE INVENTION

Figure 1:
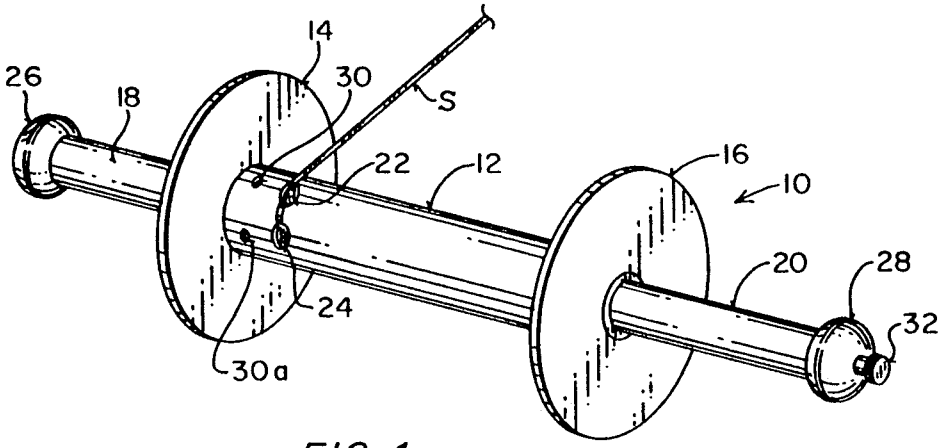
FIG. 1 is a perspective view of the reel assembly with two handles for use in manual operation.
Figure 2:
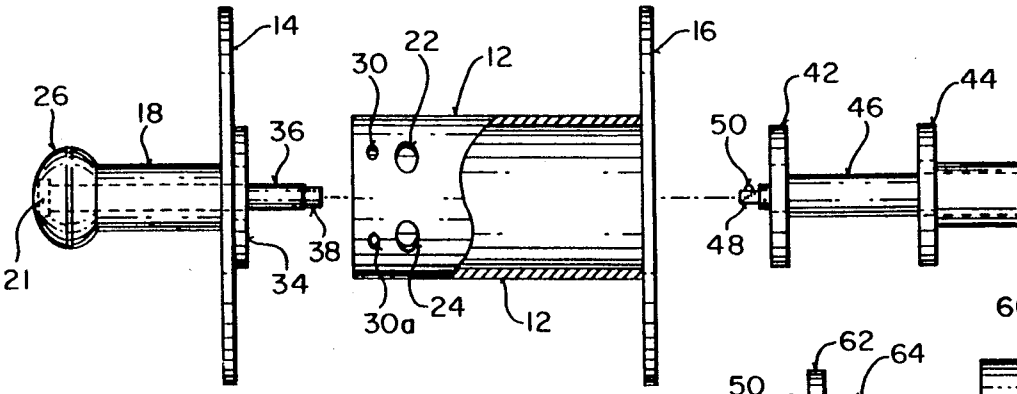
FIG. 2 is an exploded, partially sectional side view of the reel shown in FIG. 1.

Referring now to the drawings, reel assembly 10, shown in FIGS. 1 and 2, comprises a hollow spool 12 having a pair of disks 14 and 16 of about 5½ in. diameter, disk 14 being attached to one end thereof while disk 16 being secured to the opposite end of spool 12. The diameter of each disk may vary from 2½ in. to about 10 in., preferably from 4 in. to 6 in. First handle 18 has a spherical end 26 and second handle 20 has a spherical end 28 of substantially the same size and shape as spherical end 26. The end of drive shaft 36 extending outwardly of disk 14 into first handle 18 is secured by a suitable fastener, such as a Phillips screw 21, to the outer portion of spherical end 26 of handle 18 which is rotatable in both directions. The length of the handle may vary from 3 in. to 4 in. to accomodate comfortably the user's hand.

Figure 6:
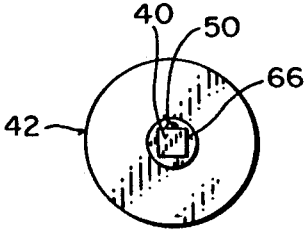
FIG. 6 is a front view of the first bushing showing the square-shaped tip of the drive shaft.
Figure 5:
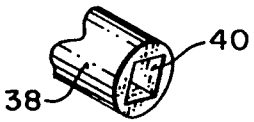
FIG. 5 is a partial perspective view of the first drive shaft showing the square-shaped aperture therein.

The inner portion of drive shaft 36 extending into the interior of spool 12 is provided with a 1½ in. diameter bushing 34 affixed to inner face of disk 14 by a pair of threaded screws (not shown) and the round inner surface of spool 12 is engageable with the outer surface of bushing 34 and secured thereto by a plurality of threaded Phillips screws 30, 30*a* passing through registering holes in spool 12 and bushing 34. The inner portion of shaft 36 has a circular end drive 38 provided with square-shaped aperture 40 shown in FIG. 5 and adapted for receiving the tips of drive shafts 48, 49 or 66, the latter being shown in FIG. 6, which are equally dimensioned for a tight engagement therewith. Thus while handle 18 is rotatable freely, drive shaft 36 is rotatable together with disk 14 to which it is affixed. Spool 12 is further provided with a pair of apertures 22 and 24 for attaching securely one end of a long kite string S, the other end thereof being attached to the kite.

The opposite side of reel assembly 10 includes a removable second handle 20 which is axially aligned with first handle 18 and has a spherical end 28 similar to end 26 of first handle 18. A thumb screw 32 is inserted into the free end of rotatable shaft 46 to guide the opposite tip of shaft 46 into aperture 40 in drive 38. Drive shaft 46 is provided with a pair of axially spaced apart inner and outer bushings 42 and 44, respectively, of substantially the same size and shape, outer bushing 44 being mounted adjacent the inner end of handle 20 and inner bushing 42 being fixedly mounted near the free end of shaft 46 which includes square-shaped tip 48 adapted for insertion into aperture 40 in first drive shaft 36. A spring pin 50 is provided on tip 48 of shaft 46 to insure a snug locking engagement of shaft 46 with aperture 40. Disk 16 is joined to the end of spool 12 by welding or in any suitable manner to form an integral structure therewith. With drive shaft 46 coupled with shaft 36, the reel assembly 10 is operable manually in unwinding string S for flying the kite at a high altitude.

Figure 3:
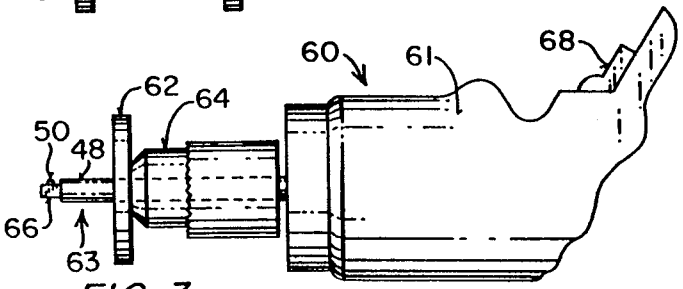
FIG. 3 is a side view of the drill-like means, a portion of which being broken away, illustrating the adapter inserted into the chuck of a drill.

An important feature of the present invention is the provision of a drive mechanism in the form of a cordless, high-speed power drill-like means 60 illustrated in FIG. 3. Drill-like means 60 comprises a body 61 of a conventional drill device 60 containing a source of energy, preferably a standard rechargeable battery (not shown) connected to a standard motor (not shown). While in a conventional drill device a drilling bit of a desired size is insertable into the chuck of the drill for the needed drilling operation, drill-like means 60 is modified by providing a novel adapter 63 having a specific structure comprising a guiding bushing 62 which is mounted substantially in the center of tubular shaft drive 48. Thus the inner portion of shaft 48 is insertable into the center of chuck 64 instead of a conventional drilling bit. The outer portion of shaft 48 is of generally the same length as the inner portion which extends in the form of a square-shaped tip 66. Drive shaft 48, preferably having a ¼ in. diameter, is suitable to be coupled with drill-like means 60. Bushing 62 is of the same dimensions as bushing 44 mounted on shaft 48, one face of bushing 44 being closely adjacent to the end portion of chuck 64. Tip 66 of drive shaft 48 having a square-shaped head is adapted for a slidable insertion into the square-shaped aperture 40 in first drive shaft 38 to produce a snug fit therewith. A small round locking means, such as spring pin 50, is provided on tip 66 of shaft 48 for locking contact thereof in aperture 40, shown in FIG. 5.

When the elements of the assembly including drill-like means 60 replacing removed second handle 20 are fitted together, first drive shaft 36 is axially aligned with third shaft 48 of drill-like means 60 for smooth rotation of spool 12. A conventional trigger 68 is provided in the body 61 of drill like means 60 to actuate drive shaft 48 for rotation at a desired high speed.

Figure 4:
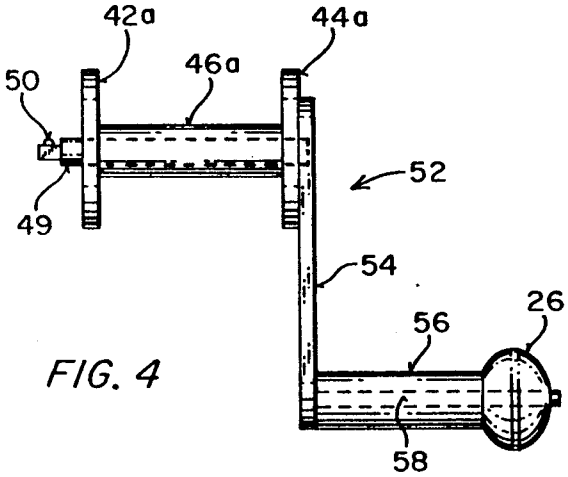
FIG. 4 is a side elevational view of the auxiliary handle.

In an another embodiment of the invention, an auxiliary crank handle member 52, shown in FIG. 4, is provided for interchangeable engagement with aperture 40 in first handle 18. Handle member 52 comprises fourth drive shaft 49 having a square-shaped tip of the same dimensions as tip 48 and likewise adapted for a snug insertion into square-shaped aperture 40 in the inner end of first drive shaft 36. Handle member 52 further comprises a pair of spaced apart bushings 42*a* and 44*a* of the same size as bushings 42 and 44 mounted centrally on drive shaft 49, an arm 54 positioned perpendicularly to the axis of drive shaft 49 and a shaft 58 extending outwardly from arm 54 at a right angle thereto, shaft 58 being housed in the interior of handle 56 rotatable around shaft 58 and having a spherical end of generally the same configuration as end 26 in first handle 18. Crank handle member 52 may be connected with drive shaft 36 by inserting slidingly drive shaft 49 including bushing 44*a* into the interior of spool 12 for a distance sufficient to attain a tight fit.

Each handle described hereinabove in accordance with the invention may preferably be formed from a high temperature resistant plastic material, such as Teflon, to insure that hands of a user holding them will be protected during unwinding or winding operation of a kite.

To unwind the kite string for a flying operation of a kite, the assembly 10 is held by the two handles using both hands of the user and is allowed to rotate freely the spool to let out the kite attached to the string S. To retrieve the kite at a high speed, the drill-like means is slidingly inserted into the spool after the second handle has been removed and the rewinding operation can be started promptly by depressing the trigger of the drill-like means to effectuate the desired high-speed rotation of the spool in order to cause the kite to return quickly to its initial position.

The following Table I illustrates, by way of an example, the merits of the present invention by comparing the usual period of time required for retrieval of a kite flying at about 1000 feet altitude by rewinding it manually by the conventional procedure, by using a power screwdriver or by using a high-speed drill-like means of the invention.

TABLE I

| | REWINDING OPERATION BY: | | |
|---|---|---|---|
| | Hand | Screwdriver* | Drill-like Means |
| Time required | 1-2 hours | 20-30 min. | 3-10 min. |

*rotating at 180 RPM

It will be noted that the speed of rotation of the spool according to the invention may be varied, if desired, from 400 RPM up to 1200 RPM. Thus using a 9.6 volt battery, the drill-like means rotating at 400 RPM will rewind the string in about 10 minutes, whereas using a 12 volt battery turning the spool at about 1200 RPM, the string will be rewound in about 3 minutes. If desired, the spool may be rotated at an intermediate speed between 400 RPM and 1200 RPM by depressing the trigger 68 of the drill. A battery may easily be recharged, if needed, by connecting it with a standard charger in the well known manner. Also, a still higher rotating speed of up to about 2500 RPM may be attained by connecting the drill-like means with an electric outlet.

It will be apparent from the foregoing description that I have devised an improved kite reel assembly characterized by a new combination of elements resulting in a high speed kite retrieval operation consuming but a fraction of time required by the commonly used at the present time manual rewinding procedure or using power screwdriver operated reels of the prior art. The basic components of my assembly are adapted to be readily interchangeable for a manual or high speed rewinding operation thus rendering my device especially desirable to parents of young users who are anxious to rewind the kite after a long outdoor flying session as rapidly as possible.

Due to simplicity of the structure of my high speed reel and its easy adaptation to a rewinding maneuver, the manufacturing cost of the assembly may be maintained at a low level. The staffs and disks forming a part of the assembly may be made of a suitable metal, such as aluminum.

It will be understood that various changes or modifications in the form or in constructional details of my invention as herein described may be made without departing from the spirit thereof or the scope of the claims which follow.

I claim:

1. In a kite reel assembly for use in flying a kite attached by a string thereto, the combination comprising:

a) a hollow string-winding spool having a circular first and second disk spaced from each other and positioned at each end of said spool;

b) a rotatable first handle housing an outer portion of a first drive shaft extending through a central opening in said first disk, an inner portion of said first drive shaft extending inwardly of said first disk and having a square-shaped aperture at the inner end thereof:

c) a bushing attached to inner face of said first disk;

d) a removable, rotatable second handle housing an outer portion of a second drive shaft extending inwardly through the central opening in said second disk, an inner portion of said second drive shaft having mounted thereon a pair of axially spaced apart from each other outer and inner bushings, said outer bushing being adapted for a position flush with outer face of said second disk and being adjacent the inner end of said second handle, said inner bushing being located adjacent the free end of said second drive shaft having a square-shaped tip adapted for a snug insertion into said square-shaped aperture in the inner end of said first drive shaft;

e) a high speed power drill-like means comprising an adapter having a third drive shaft coupled with a chuck of said drill-like means, said adapter including a bushing mounted on said third drive shaft adjacent said chuck, the free end of said third drive shaft having a square-shaped tip adapted for slidable snug insertion into said square-shaped aperture in the inner free end of said first drive shaft, said third drive shaft being axially aligned with said first drive shaft, said drill-like means being interchangeably coupled with said first drive shaft upon removal of said second handle from said reel assembly.

2. The reel assembly of claim 1 wherein an auxiliary crank handle member suitable for being coupled interchangeably with said first handle comprises a fourth drive shaft having a square-shaped tip adapted for snug insertion into said square-shaped aperture in the inner end of said first drive shaft, a pair of spaced apart bushings mounted centrally on said fourth drive shaft, an arm positioned perpendicularly to the axis of said fourth drive shaft and a shaft extending outwardly from said arm at a right angle thereto, said shaft being housed in the interior of said crank handle.

3. The reel assembly of claim 1 wherein the end of each of said handles is in a ball-like shape.

4. The reel assembly of claim 1 wherein each of said handles is formed from a high temperature resistant plastic material.

5. The reel assembly of claim 4 wherein said plastic material comprises Teflon.

6. The reel assembly of claim 1 wherein each of said disks is of substantially the same dimensions.

7. The reel assembly of claim 1 wherein each of said tips of said shaft drives includes a small round locking means.

8. The reel assembly of claim 1 wherein said spool comprises a plurality of holes at the end adjacent said first disk, said holes registering with holes in said bushing for securing said spool to said bushing.

9. The reel assembly of claim 1 wherein a threaded screw is fitted into the end of said second drive shaft for lining up said square-shaped tip with said square-shaped aperture.

10. A kite reel assembly operative at a high speed comprising in combination:

a) a hollow rotatable spool having a circular disk including a central opening at each side of said spool;

b) a power drill-like means having an adapter inserted in a chuck thereof, said adapter comprising a first drive shaft having a square-shaped tip and a bushing mounted on said drive shaft adjacent said chuck; and c) a handle positioned on outer side of a second disk, said handle housing a second drive shaft passing through said central opening in said second disk and extending into interior of said spool, the free end of said second drive shaft having a square-shaped aperture adapted to receive said square-shaped tip in a tight engagement therewith.

* * * * *